US009410429B2

(12) United States Patent
Watson et al.

(10) Patent No.: US 9,410,429 B2
(45) Date of Patent: Aug. 9, 2016

(54) AIR COOLING SHAFT AT BEARING INTERFACE

(71) Applicant: Pratt & Whitney Canada Corp., Longueuil (CA)

(72) Inventors: John Watson, Saint-Lambert (CA); Guy Bouchard, Mont St-Hilaire (CA); Daniel Blais, St-Jean sur Richelieu (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 634 days.

(21) Appl. No.: 13/690,083

(22) Filed: Nov. 30, 2012

(65) Prior Publication Data

US 2014/0150449 A1 Jun. 5, 2014

(51) Int. Cl.
*F01D 25/12* (2006.01)
*F01D 5/02* (2006.01)
*F01D 25/16* (2006.01)

(52) U.S. Cl.
CPC ..... *F01D 5/026* (2013.01); *F01D 25/125* (2013.01); *F01D 25/16* (2013.01)

(58) Field of Classification Search
CPC ..... F01D 5/026; F01D 5/08; F01D 25/125
See application file for complete search history.

(56) References Cited

U.S. PATENT DOCUMENTS 2,860,851 A * 11/1958 Halford et al. ..... 416/97 R
4,086,759 A 5/1978 Karstensen et al.
4,793,772 A 12/1988 Zaehring et al.
5,271,711 A 12/1993 McGreehan et al.
5,472,313 A 12/1995 Quinones et al.
5,564,896 A 10/1996 Beeck et al.
5,593,274 A 1/1997 Carreno et al.
5,619,850 A 4/1997 Palmer et al.
6,155,040 A 12/2000 Sasaki
6,293,089 B1 9/2001 Sasaki
6,334,755 B1 1/2002 Coudray et al.
6,450,758 B1 9/2002 Schmidt
6,513,335 B2 2/2003 Fukutani
6,582,187 B1 6/2003 Skockley et al.
6,655,153 B2 12/2003 Akiyama et al.
6,860,110 B2 3/2005 Akiyama et al.
7,624,580 B2 12/2009 Fukutani

FOREIGN PATENT DOCUMENTS

GB 595348 A * 12/1947 ..... F01D 25/125

* cited by examiner

*Primary Examiner* — Richard Edgar
(74) *Attorney, Agent, or Firm* — Norton Rose Fulbright Canada LLP

(57) ABSTRACT

A gas turbine engine including a compressor rotor and a turbine rotor connected by a compressor shaft portion connected to the compressor rotor and a turbine shaft portion connected to the turbine rotor. The compressor shaft portion and the turbine shaft portion are connected axially together by a shaft coupling, between the compressor rotor and the turbine rotor, and at least a bearing rotatably coupled to the compressor shaft portion adjacent the shaft coupling. The compressor shaft and/or the turbine shaft are provided with openings permitting cooling air to enter air passages in the area of the shaft coupling and surrounding the end of the turbine shaft portion, in order to dissipate heat originating at the turbine rotor and thus reducing the thermal stresses at the bearing.

15 Claims, 3 Drawing Sheets

AIR COOLING SHAFT AT BEARING INTERFACE

TECHNICAL FIELD

The present disclosure relates to gas turbine engines and more particularly to improvements in the cooling of coupled shafts.

BACKGROUND OF THE ART

Shaft and bearing deformation may occur at the interface of a bearing inner race and the shaft to which it is coupled, because of the heat generated by the turbine rotor and conducted by the shaft supporting the turbine rotor, especially when the bearing is close to the turbine rotor. This phenomenon of coning has been found to be especially problematic in gas turbine engines where the main shaft bearing is between the compressor module and the turbine module and in close proximity to the turbine module. The thermal conduction from the turbine rotor has resulted in coning of the shaft as well as of the bearing, leading to premature bearing distress.

SUMMARY

In one aspect, there is provided a gas turbine engine having at least a spool assembly including at least a compressor rotor and a turbine rotor connected by a shaft assembly, the shaft assembly comprising: a compressor shaft portion connected to the compressor rotor and a turbine shaft portion connected to the turbine rotor; the compressor shaft portion and the turbine shaft portion connected axially together by a shaft coupling between the compressor rotor and the turbine rotor and at least a bearing rotatably coupled to the shaft assembly adjacent the shaft coupling; at least one of the compressor shaft and the turbine shaft being provided with openings between the bearing and the shaft coupling to permit cooling air to enter air passages in the area of the shaft coupling; and a source of pressurized cooling air in communication with the openings provided in the shaft assembly to direct such cooling air to the shaft coupling.

In a second aspect, there is provided a shaft assembly for a gas turbine engine of the type including at least a compressor rotor and a turbine rotor connected by the shaft assembly; the shaft assembly comprising a compressor shaft portion adapted to be connected to the compressor rotor and a turbine shaft portion adapted to be connected to the turbine rotor; the compressor shaft portion and the turbine shaft portion connected axially together by a shaft coupling arranged to be between the compressor rotor and the turbine rotor and the shaft assembly adapted to be rotatably coupled to at least a bearing adjacent the shaft coupling; at least one of the compressor shaft and the turbine shaft being provided with openings between the bearing and the shaft coupling to permit cooling air to enter air passages in the area of the shaft coupling.

DESCRIPTION OF THE DRAWINGS

Reference is now made to the accompanying figures in which.

Further details of these and other aspects of the present invention will be apparent from the detailed description and figures included below.

DETAILED DESCRIPTION

Figure 1:
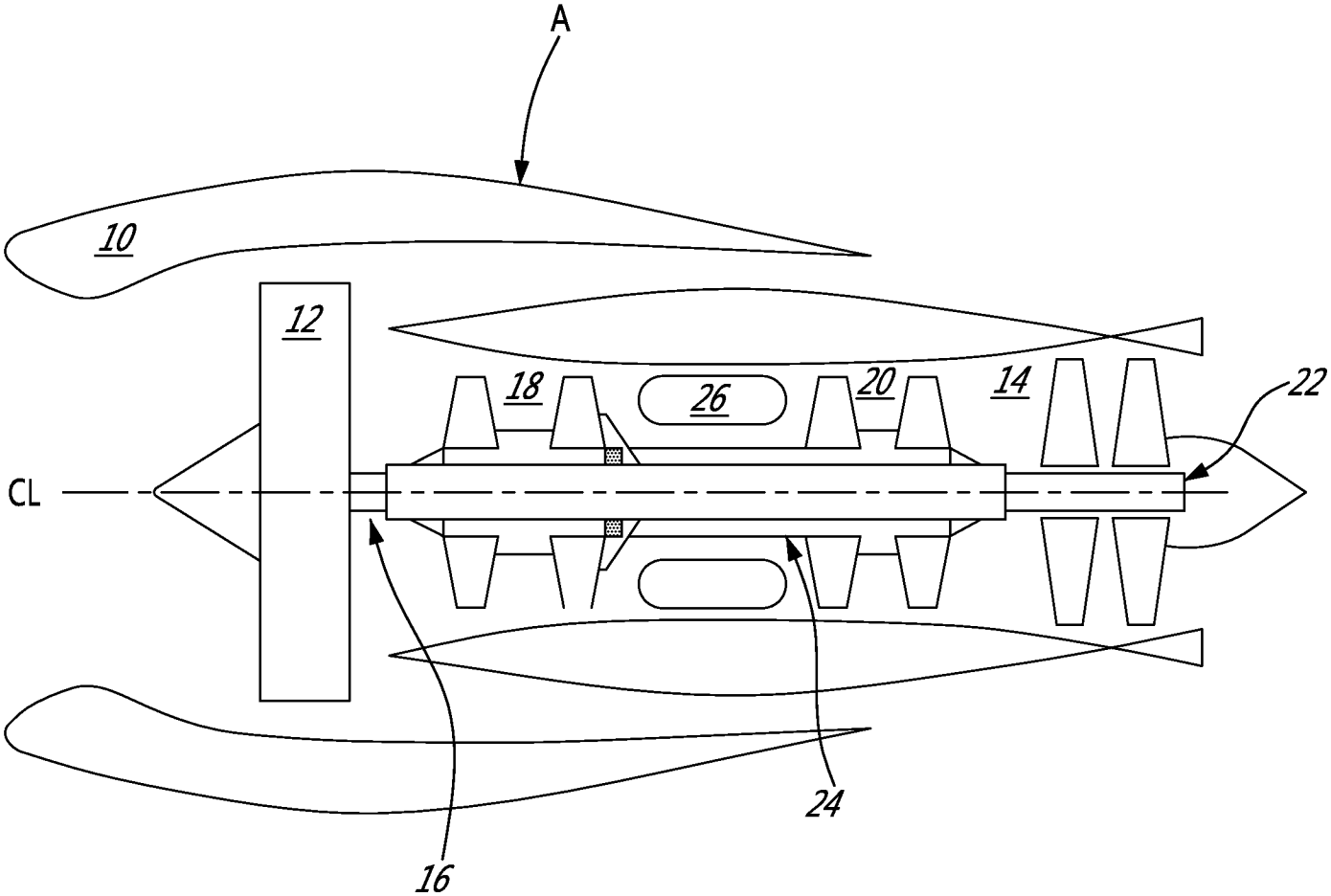
FIG. 1 is a schematic cross-sectional view of a gas turbine engine illustrating a multishaft configuration.

FIG. 1 schematically depicts a turbofan engine A which, as an example, illustrates the application of the described subject matter. The turbofan engine A includes a nacelle 10, a low pressure spool assembly which includes at least a fan 12 and a low pressure turbine 14 connected by a low pressure shaft 16, and a high pressure spool which includes a high pressure compressor 18 and a high pressure turbine 20 and a high pressure shaft 24. The engine further comprises a combustor 26.

Figure 2:
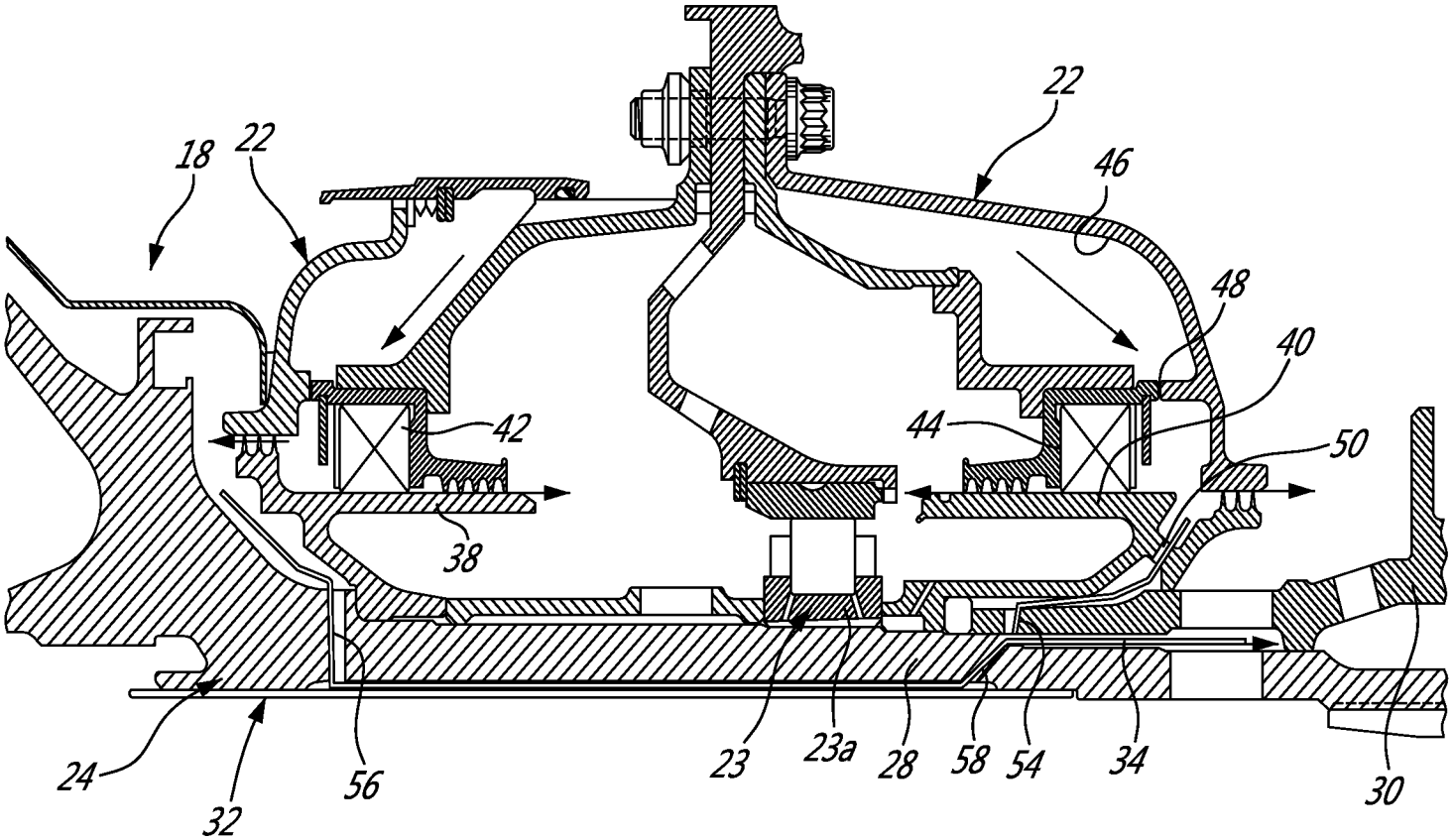
FIG. 2 is a partly fragmented axial cross-sectional view showing a detail of a preferred embodiment.

Referring to FIG. 2, the high pressure shaft 24 includes a compressor stub shaft 28 coupled to a turbine stub shaft 30 at spline 34. The stub shaft 28 typically has an inner diameter. The shield 32 may be within the inner diameter of the stub shaft 28. Other coupling configurations may be used for the interconnection between the stub shafts 28 and 30, such as a curvic coupling among other possibilities.

FIG. 2 shows a bearing housing 22 isolating a main bearing 23, the main bearing 23 supporting the shaft 24 and more particularly, compressor shaft segment 28. In FIG. 2, an inner race of the bearing 23 is mounted directly onto the shaft 24. The bearing housing 22 also includes a pair of oil-air seals 42 and 44 operatively engaging seal runners 38 and 40 mounted to the compressor stub shaft 28. A cooling air plenum 46 is also defined within the bearing housing 22.

Turbine shaft 30, which may be at a relatively high temperature due to its direct connection with the turbine rotor (not shown), may thus create thermal stresses within the compressor shaft 28, thus resulting in coning in the area of the interface of shaft 28 with the inner race 23*a* of bearing 23. This coning may result from the fact that the compressor stub shaft 28 is relatively cooler than the portion of the compressor shaft coupled to the hotter turbine stub shaft 30, especially since the bearing 23 is located in a very hot environment between the high pressure compressor 18 and the turbine 20.

Figure 3:
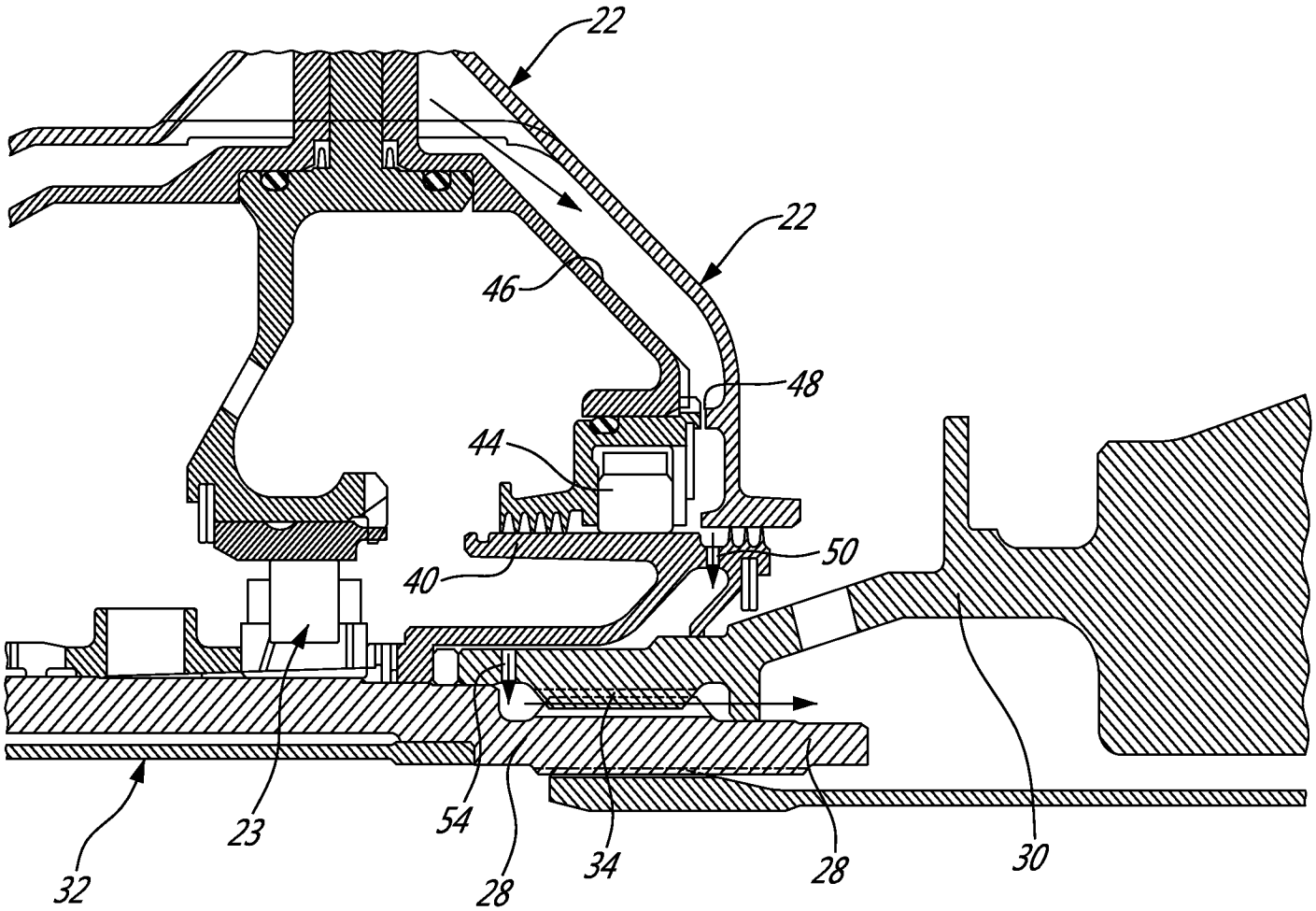
FIG. 3 is an enlarged axial cross-section view of the detail similar to that shown in FIG. 2.

As shown in more detail in FIG. 3, in an embodiment slightly modified from FIG. 2, relatively cooler, pressurized air from the plenum 46 passes through an opening 48, then through opening 50 in the seal runner 40, and then through passage 54 in the end of the stub shaft 30. This pressurized air is then forced through the spline interface at the spline 34. In this manner, the forward end of the stub shaft 30 which is now surrounded by cooler air, is cooled towards a thermal equilibrium with compressor shaft 28.

Alternatively, or additionally, cooling air may be brought to the spline 34 and thus to further surround stub shaft 30 with cool air, by allowing the bleeding of compressor air or externally cooled air to enter through a passage 56 in compressor shaft 28, on the forward side of the bearing housing 22. This pressurized cooling air can then follow a conduit defined between the shield 32 and the inner diameter of the high pressure compressor stub shaft 28 to then exit into this spline interface 34 by means of a passage 58 in the stub shaft 28.

It is pointed out that many of the components described above as being about the shafts 28 and 30 are annular. Accordingly, the various passages such as opening 48, opening 50, passage 56 and passage 58 may or many not be circumferentially distributed on the structural components in which they are defined.

The provision of pressurized cooling air through the shaft 24, particularly around the end of the turbine stub shaft 30 by way of the shaft coupling, such as the spline coupling 34, may contribute to the reduction of the thermal gradient at the compressor stub shaft 28 in the area of the bearing 23. This arrangement may reduce the occurrence of shaft or bearing race coning.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A gas turbine engine having at least a spool assembly including at least a compressor rotor and a turbine rotor connected by a shaft assembly, the shaft assembly comprising: a compressor shaft portion connected to the compressor rotor and a turbine shaft portion connected to the turbine rotor; the compressor shaft portion and the turbine shaft portion connected axially together by a shaft coupling between the compressor rotor and the turbine rotor and at least a bearing rotatably coupled to the compressor shaft portion adjacent the shaft coupling; the compressor shaft being provided with fore openings and defining at least one air passage extending fore to aft of the bearing to permit cooling air to enter the at least one air passage via the fore openings to cool a portion of the compressor shaft portion opposite the bearing; and a source of pressurized cooling air in communication with the fore openings to direct such cooling air to the at least one air passage, wherein the compressor shaft is hollow and comprises an inner diameter and a shield inwardly from the shaft inner diameter with the at least one air passage defined therebetween; and further wherein aft openings in the compressor shaft portion communicate the pressurized cooling air from the at least one air passage to the shaft coupling.

2. The gas turbine engine as defined in claim 1, wherein the source of pressurized cooling air is a pressurized air plenum.

3. The gas turbine engine as defined in claim 1, wherein the shaft coupling is a spline coupling with additional air passages extending axially through the spline coupling.

4. The gas turbine engine as defined in claim 1, wherein the bearing is isolated within a bearing housing and a pressurized air plenum is associated with an aft portion of the bearing housing, the plenum being in communication with the aft openings in the compressor shaft portion.

5. The gas turbine engine as defined in claim 1, wherein the bearing is isolated within a bearing housing and a pressurized cooling air source is provided forward of the bearing housing in communication with the fore openings in the shaft assembly.

6. The gas turbine engine as defined in claim 5, wherein the fore openings are provided in the compressor shaft portion forward of the bearing housing and the at least one air passage is provided in association with the compressor shaft portion to communicate the pressurized cooling air with the shaft coupling.

7. The gas turbine engine in accordance with claim 6, wherein the shaft coupling is a spline coupling with air passages extending axially through the spline coupling.

8. The gas turbine engine as defined in claim 1, wherein an inner race of the bearing is mounted directly onto the compressor shaft portion.

9. A shaft assembly for a gas turbine engine of the type including at least a compressor rotor and a turbine rotor connected by the shaft assembly; the shaft assembly comprising a compressor shaft portion adapted to be connected to the compressor rotor and a turbine shaft portion adapted to be connected to the turbine rotor; the compressor shaft portion and the turbine shaft portion connected axially together by a shaft coupling arranged to be between the compressor rotor and the turbine rotor, the compressor shaft portion adapted to be rotatably coupled to at least a bearing adjacent the shaft coupling; the compressor shaft portion being provided with fore openings and defining at least one air passage extending fore to aft of the bearing to permit cooling air to enter the at least one air passage via the fore openings to cool a portion of the compressor shaft portion opposite the bearing, the compressor shaft being hollow and comprising an inner diameter and a shield inwardly from the shaft inner diameter with the at least one air passage defined therebetween; and further wherein aft openings in the compressor shaft portion communicate the pressurized cooling air from the at least one air passage to the shaft coupling.

10. The shaft assembly as defined in claim 9, wherein the shaft coupling is a spline coupling with air passages extending axially through the spline coupling.

11. The shaft assembly as defined in claim 9, further comprising openings in the turbine shaft portion in communication with a source of pressurized cooling air to surround the end of the turbine shaft portion at the shaft coupling.

12. The shaft assembly as defined in claim 11, wherein the shaft coupling is a spline coupling with air passages extending axially through the spline coupling.

13. The shaft assembly as defined in claim 9, wherein the fore openings are provided in the compressor shaft portion forward of the location of the bearing and the at least one air passage is provided in association with the compressor shaft portion to communicate the pressurized cooling air with the shaft coupling.

14. The shaft assembly as defined in claim 13, wherein the shaft coupling is a spline coupling with air passages extending axially through the spline coupling.

15. The shaft assembly as defined in claim 9, wherein an inner race of the bearing is mounted directly onto the compressor shaft portion.

* * * * *